US008578709B2

(12) United States Patent
Tsukamoto et al.

(10) Patent No.: US 8,578,709 B2
(45) Date of Patent: Nov. 12, 2013

(54) OVER-LOADING PREVENTION DEVICE OF CONSTRUCTION MACHINERY

(75) Inventors: Hiroyuki Tsukamoto, Chiba (JP); Takashi Nishi, Chiba (JP)

(73) Assignee: Sumitomo (S.H.I.) Construction Machinery Co., Ltd., Tokyo (JP)

( * ) Notice: Subject to any disclaimer, the term of this patent is extended or adjusted under 35 U.S.C. 154(b) by 1100 days.

(21) Appl. No.: 12/225,448

(22) PCT Filed: Apr. 27, 2007

(86) PCT No.: PCT/JP2007/059200

§ 371 (c)(1), (2), (4) Date: Sep. 22, 2008

(87) PCT Pub. No.: WO2007/129613

PCT Pub. Date: Nov. 15, 2007

(65) Prior Publication Data

US 2009/0293470 A1 Dec. 3, 2009

(30) Foreign Application Priority Data

May 10, 2006 (JP) ..... 2006-131975

(51) Int. Cl.
*F15B 11/16* (2006.01)
*F15B 20/00* (2006.01)

(52) U.S. Cl.
USPC ..... 60/445; 60/452

(58) Field of Classification Search
USPC ..... 60/445, 452
See application file for complete search history.

(56) References Cited

U.S. PATENT DOCUMENTS 5,743,089 A * 4/1998 Tohji ..... 60/452

FOREIGN PATENT DOCUMENTS

| | | | |
|---|---|---|---|
| EP | 0539589 | A1 | 5/1993 |
| JP | 02-153236 | | 6/1990 |
| JP | 05-045202 | U | 6/1993 |
| JP | 05-312082 | | 11/1993 |
| JP | 2000-161302 | * | 6/2000 |
| JP | 2001-271677 | | 10/2001 |
| JP | 2003-138957 | | 5/2003 |
| JP | 2004-162816 | | 6/2004 |
| JP | 2005-076670 | | 3/2005 |
| WO | 98/06936 | | 2/1998 |

* cited by examiner

*Primary Examiner* — F. Daniel Lopez
(74) *Attorney, Agent, or Firm* — Squire Sanders (US) LLP

(57) ABSTRACT

In an over-loading prevention device including a hydraulic pump, a control valve, and a control lever, a discharge-quantity control unit performs constant-torque control which decreases a discharge quantity in proportion to an increase in a discharge pressure in the pump to control an input torque of the pump uniformly. An operation-state detection unit detects an actuation state of the control lever. A control unit outputs a control signal that sets the pump input torque to a minimum torque according to the constant-torque control, to the discharge-quantity control unit when the control lever is operated over a predetermined speed, and subsequently changes a level of the control signal to a maximum torque according to the constant-torque control in accordance with a predetermined control pattern to raise the pump input torque.

5 Claims, 9 Drawing Sheets

OVER-LOADING PREVENTION DEVICE OF CONSTRUCTION MACHINERY

TECHNICAL FIELD

This invention generally relates to an over-loading prevention device of construction machinery, and more particularly to an over-loading prevention device of construction machinery which is capable of reducing the fuel consumption for all the construction operations in construction machinery, such as a hydraulic excavator, using an internal-combustion engine as its drive source.

BACKGROUND ART

There is known a hydraulic-pump driving system controlling device as shown in FIG. 7, which is a conventional over-loading prevention device of construction machinery.

In the hydraulic-pump driving system controlling device of FIG. 7, a variable-capacity hydraulic pump (main pump) 2 which is driven by an engine (internal-combustion engine) 1, and a pilot pump 3 are provided. A discharge outlet of the variable capacity hydraulic pump 2 communicates with a control valve 4 which controls supply and exhaust of hydraulic pressure from the variable capacity hydraulic pump 2 to a hydraulic actuator which is not illustrated.

In the hydraulic-pump driving system controlling device of FIG. 7, pilot ports 4*a* which are provided at both ends of the control valve 4 respectively communicate with a pilot-pressure discharge outlet of a control lever 6 via a pilot-pressure introducing line 5. A pilot pressure from the pilot pump 3 is introduced into the control lever 6 via the line which is not illustrated, and the introduced pressure is used as a pilot pressure to operate the control valve 4.

Moreover, the discharge outlet of the variable capacity hydraulic pump 2 communicates with a hydraulic pressure inlet of a regulator (discharge-quantity control unit) 7 via a line 13. The variable capacity hydraulic pump 2 supplies a discharge pressure to the regulator 7 to decrease the discharge quantity in proportion to an increase in the discharge pressure. Thus, the variable capacity hydraulic pump 2 is operated by performing a constant-torque control (or constant-horsepower control) which controls the input torque uniformly so that the input torque may not exceed an engine torque.

Moreover, the variable capacity hydraulic pump 2 is operated by performing a flow control which increases or decreases the discharge quantity in accordance with the control input of the control lever 6. FIG. 8 shows the constant-horsepower control which is performed in the hydraulic-pump driving system controlling device of FIG. 7, and the constant-horsepower curves (in H mode and L-mode) are indicated.

If a hydraulic excavator including a hydraulic actuator is considered as a typical construction machinery, various construction operations, including heavy-load digging, light-load digging, finishing, etc. are performed using the hydraulic excavator.

In order to control the input torque of the variable capacity hydraulic pump 2 so that an optimal input torque for one of the various construction operations may be selected, the hydraulic-pump driving system controlling device of FIG. 7 is provided with a mode selector switch 8, a controller (control unit) 9, and an electromagnetic inverse-proportion valve (input torque control unit) 10. The mode selector switch 8 outputs an external signal. The controller 9 receives this external signal from the mode selector switch 8 and outputs a torque setting signal. The electromagnetic inverse-proportion valve 10 receives this torque setting signal from the controller 9 and outputs a secondary pressure Pf.

The mode selector switch 8, the controller 9, and the electromagnetic inverse-proportion valve 10 mentioned above constitute an operation-mode selector circuit. The secondary pressure Pf from the electromagnetic inverse-proportion valve 10 is supplied to the regulator 7, and as shown in FIG. 8, the input torque of the variable capacity hydraulic pump 2 is changed between Tmax and Tmin, and the input torque is set to an input torque value between Tmax and Tmin according to the level of the external signal from the mode selector switch 8.

FIG. 9 is a time chart for explaining the respective characteristics of the parts of the hydraulic-pump driving system controlling device of FIG. 7 when usual digging is performed using a hydraulic excavator as construction machinery and the constant-horsepower control is set in the H mode.

If sudden actuation of the control lever 6 is performed as shown in FIGS. 9 (*a*) and (*b*), the discharge quantity Q of the variable capacity hydraulic pump 2 begins to increase. Simultaneously, in order to operate the hydraulic actuator, starting pressure occurs, and the discharge pressure P of the variable capacity hydraulic pump 2 increases rapidly to P1 (see FIG. 9 (*c*)).

When the constant-horsepower control is set in the H mode, in order to control uniformly the input torque of the variable capacity hydraulic pump 2, the secondary pressure Pf of the electromagnetic inverse-proportion valve 10 is set to the predetermined value Pf1 (see FIG. 9 (*f*)).

Since the constant-horsepower control set in the H mode cannot respond to the sudden rise to the discharge pressure P1 at this time, while the discharge pressure P of the variable capacity hydraulic pump 2 increases quickly, the input torque T of the variable capacity hydraulic pump 2 exceeds the torque when the engine speed N is at the nominal-speed N0, and it is set to T1 (see FIG. 9 (*d*)).

As a result, the engine speed N of the engine 1 falls to the engine speed N1 at which the torque is balanced, and the pump discharge quantity Q temporarily falls with this lowering (lag down) of the engine speed (see FIGS. 9 (*e*) and (*b*)).

Once the hydraulic actuator operates, the sliding state of the respective parts changes from static friction to dynamic friction and the pump discharge pressure P falls to P2. The input torque T of the variable capacity hydraulic pump 2 also falls to Tmax and the pump discharge quantity Q increases to Q1, thereby returning to the control state of the constant-horsepower control.

However, while the engine speed is falling, controlling the engine 1 to increase the fuel injection quantity is performed in order to return the engine-speed N to the nominal speed N0. As shown in FIGS. 9 (*e*) and (*g*), the control to increase the lowered engine-speed N back to the nominal speed N0 is performed by increasing the fuel injection quantity q of the engine 1 from q1 to q2 at the time of lowering of the engine speed. By increasing the fuel injection quantity q from q1 to q2, the fuel injection quantity equivalent to the shaded portion F indicated in FIG. 9 (*g*) will be a cause of increase in the fuel consumption of the engine 1.

For example, Japanese Laid-Open Patent Application No. 2005-76670 discloses an engine lag-down prevention device of construction machinery which is known as a conventional over-loading prevention device of construction machinery. This engine lag-down prevention device includes a main pump which is driven by an engine, a torque control valve which adjusts a maximum pump torque of the main pump, a hydraulic actuator which is driven by a hydraulic pressure supplied from the main pump, and an operation device which operates the hydraulic actuator.

Moreover, in the engine lag-down prevention device, a torque control unit is arranged. This torque control unit is arranged to control the torque control valve to gradually increase the hydraulic pump torque based on a predetermined torque increasing rate with the progress of time from the end of a predetermined torque holding time for which the low pump torque is held, immediately after the operation device is operated from the non-operating state.

Since the engine lag-down prevention device of Japanese Laid-Open Patent Application No. 2005-76670 is arranged so that the hydraulic-pump torque is increased gradually by the torque control unit, the load acting on the engine can be reduced even after the end of the predetermined torque holding time. Accordingly, the engine lag-down after the end of the predetermined torque holding time can be reduced to a small amount.

Patent Document 1: Japanese Laid-Open Patent Application No. 2005-76670

DISCLOSURE OF THE INVENTION

Problem to be Solved by the Invention

However, in the hydraulic-pump driving system controlling device of FIG. 7, when sudden actuation of the control lever is performed, the discharge pressure of the variable capacity hydraulic pump is increased abruptly. And the input torque of the variable capacity hydraulic pump is increased in the process of the sudden rise of the discharge pressure so that the increased input torque exceeds the torque when the engine speed is at the nominal speed.

As a result, the engine lag down occurs to the engine speed at which the torque is balanced. When the engine lag-down occurs, controlling the engine to suddenly increasing the fuel injection quantity is performed in order for returning the engine speed back to the nominal speed, thereby worsening the fuel consumption of the engine.

Since the discharge quantity is temporarily reduced by the engine lag-down, the discharging speed of the hydraulic actuator is changed which casts the adverse effect on the ease of operation of the variable capacity hydraulic pump.

The engine lag-down prevention device of Japanese Laid-Open Patent Application No. 2005-76670 is arranged so that the pump torque is increased gradually by the above-mentioned torque control unit, and an engine lag-down after the progress of the predetermined torque holding time may be reduced to a small amount. However, since the engine lag-down does occur even if it is reduced to a small amount, the increase in the fuel injection quantity is unavoidable.

In view of the above-mentioned problems, according to one aspect of the invention, there is disclosed an over-loading prevention device of construction machinery which prevents occurrence of an engine lag-down at the time of a sudden rise of the discharge pressure of the hydraulic pump and prevents rapid increase of the engine fuel injection quantity, so that the fuel consumption for all the construction operations in construction machinery may be reduced and the ease of operation of the hydraulic actuator may be improved.

Means for Solving the Problem

In order to achieve the above-mentioned aspect, the invention provides a over-loading prevention device of construction machinery comprising: a hydraulic pump which is driven by an internal-combustion engine; a control valve which controls supply of a hydraulic pressure from the hydraulic pump to a hydraulic actuator and exhaust of a hydraulic pressure from the hydraulic actuator; a control lever which outputs a pilot pressure to operate the control valve; a discharge-quantity control unit which performs constant-torque control which decreases a discharge quantity in proportion to an increase in a discharge pressure in the hydraulic pump to control an input torque of the hydraulic pump uniformly; an operation-state detection unit which detects an actuation state of the control lever; and a control unit which outputs a control signal that sets the input torque of the hydraulic pump to a minimum torque value according to the constant-torque control, to the discharge-quantity control unit when it is determined based on the actuation state detected by the operation-state detection unit that the control lever is operated over a predetermined speed, and subsequently the control unit changing a level of the control signal to a maximum torque value according to the constant-torque control, in accordance with a predetermined control pattern to raise the input torque of the hydraulic pump.

The above-mentioned over-loading prevention device may be arranged so that the predetermined control pattern used by the control unit is selected from among a first control pattern that causes the level of the control signal to be returned to a level equivalent to the maximum torque value within a predetermined time, a second control pattern that causes the level of the control signal to be gradually returned by a number of increments of an arbitrary amount to a level equivalent to the maximum torque value when an engine speed of the engine is within a range of a given engine speed to a target engine speed, and a third control pattern that causes the level of the control signal to be temporarily returned to an arbitrary level within a predetermined time and subsequently causes the level of the control signal to be gradually returned by a number of increments of an arbitrary amount to a level equivalent to the maximum torque value when an engine speed of the engine is within a range of a given engine speed to a target engine speed.

The above-mentioned over-loading prevention device may be arranged so that the hydraulic pump is constituted by a variable capacity hydraulic pump, and the operation-state detection unit is constituted by a pressure sensor connected to the control lever.

Effects of the Invention

According to the invention, even if sudden actuation of the control lever is performed and the discharge pressure of the hydraulic pump is increased abruptly, the over-loading prevention device is controlled so that the input torque of the hydraulic pump does not exceed the engine torque. An engine lag-down in which the engine speed falls does not occur and rapid increase of the fuel injection quantity of the internal-combustion engine can be prevented. Thus, the fuel consumption for all the construction operations in the construction machinery can be reduced. Since an engine lag-down does not occur, the phenomenon in which the discharge quantity of the hydraulic pump temporarily falls does not occur, and the ease of operation of the hydraulic actuator which operates with the hydraulic pressure supplied from a hydraulic pump can be improved.

According to the invention, in the controlled state in which the input torque of the variable capacity hydraulic pump does not exceed the engine torque, an arbitrary control pattern processing in which the level of a control signal is returned within a predetermined time to a level that the input torque of the variable capacity hydraulic pump is held constant may be performed. This makes it possible to return the input torque of the variable capacity hydraulic pump to the previously controlled state before sudden actuation of the control lever.

DESCRIPTION OF REFERENCE NUMERALS

1 engine (internal combustion engine)
2 variable-capacity hydraulic pump (main pump)
4 control valve
6 control lever
7 regulator (discharge-quantity control unit)
8 mode selector switch
9 controller (control unit)
10 electromagnetic inverse-proportion valve (input torque control unit)
11 shuttle valve
12 pressure sensor (operation-state detection unit)
22 supercharging pressure sensor

BEST MODE FOR CARRYING OUT THE INVENTION

A description will now be given of embodiments of the invention with reference to the accompanying drawings.

Figure 1:
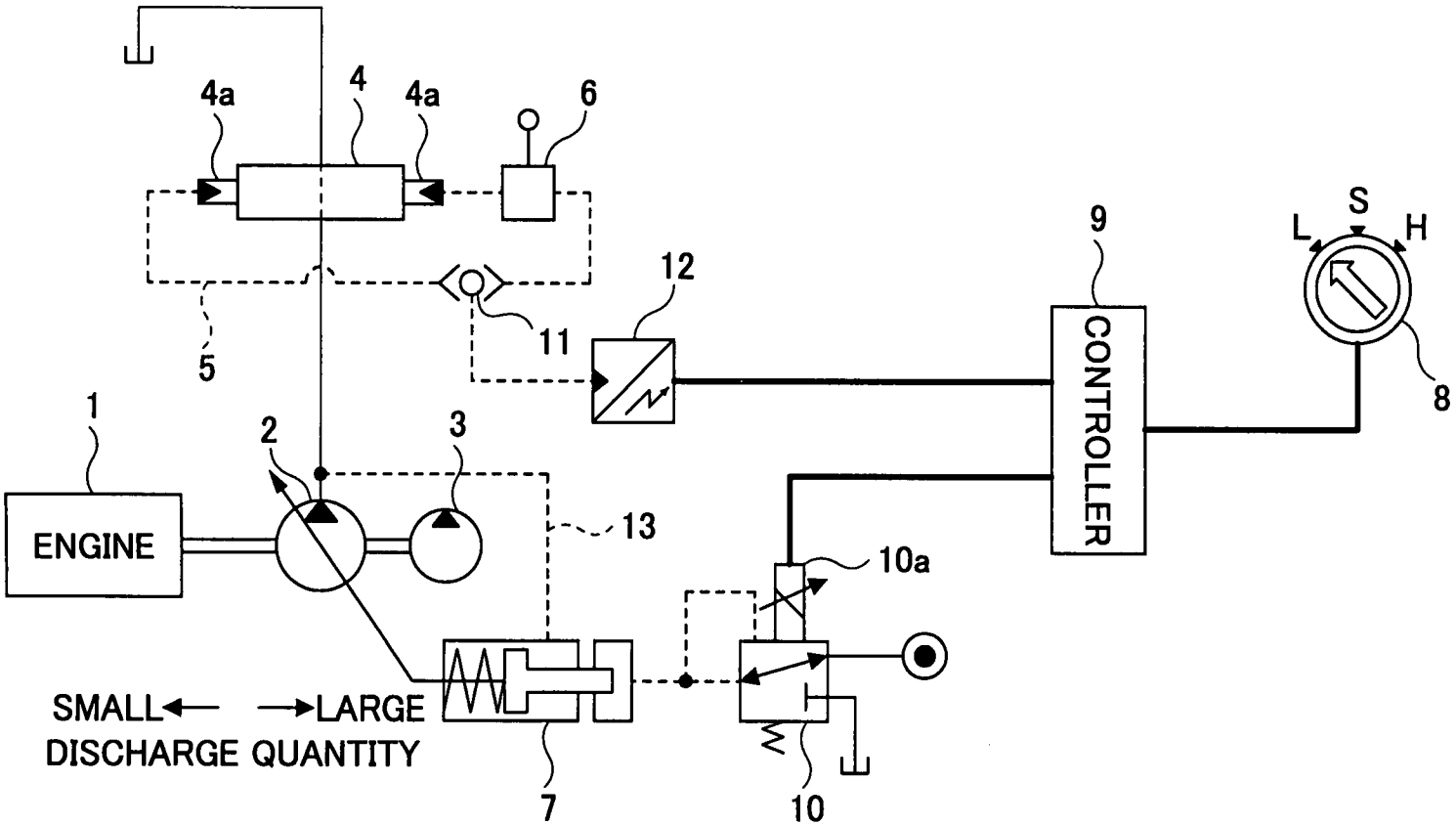
FIG. 1 is a diagram showing the hydraulic circuit of an over-loading prevention device of construction machinery in an embodiment of the invention.
Figure 2:
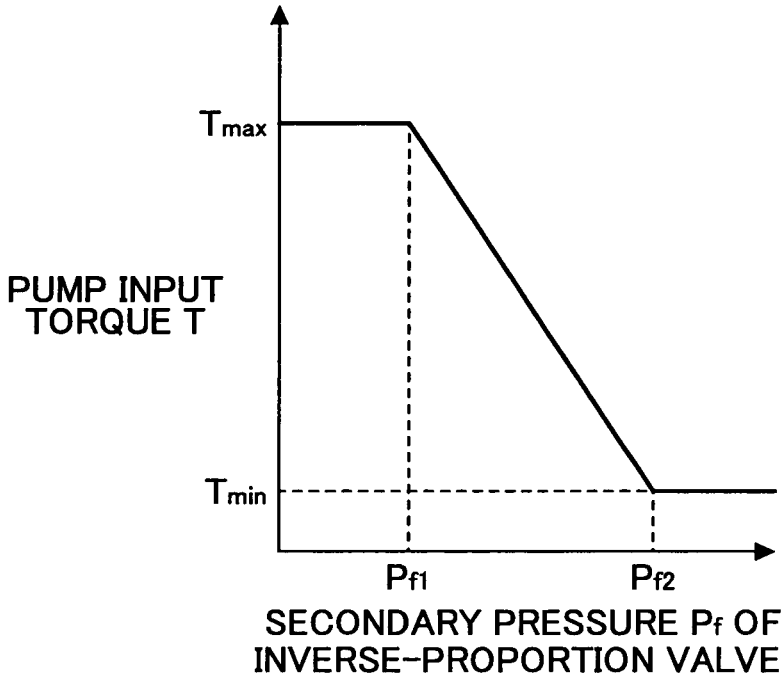
FIG. 2 is a diagram for explaining the torque characteristic showing the relationship between a secondary pressure of an electromagnetic inverse-proportion valve and a pump input torque in the embodiment of FIG. 1.
Figure 3:
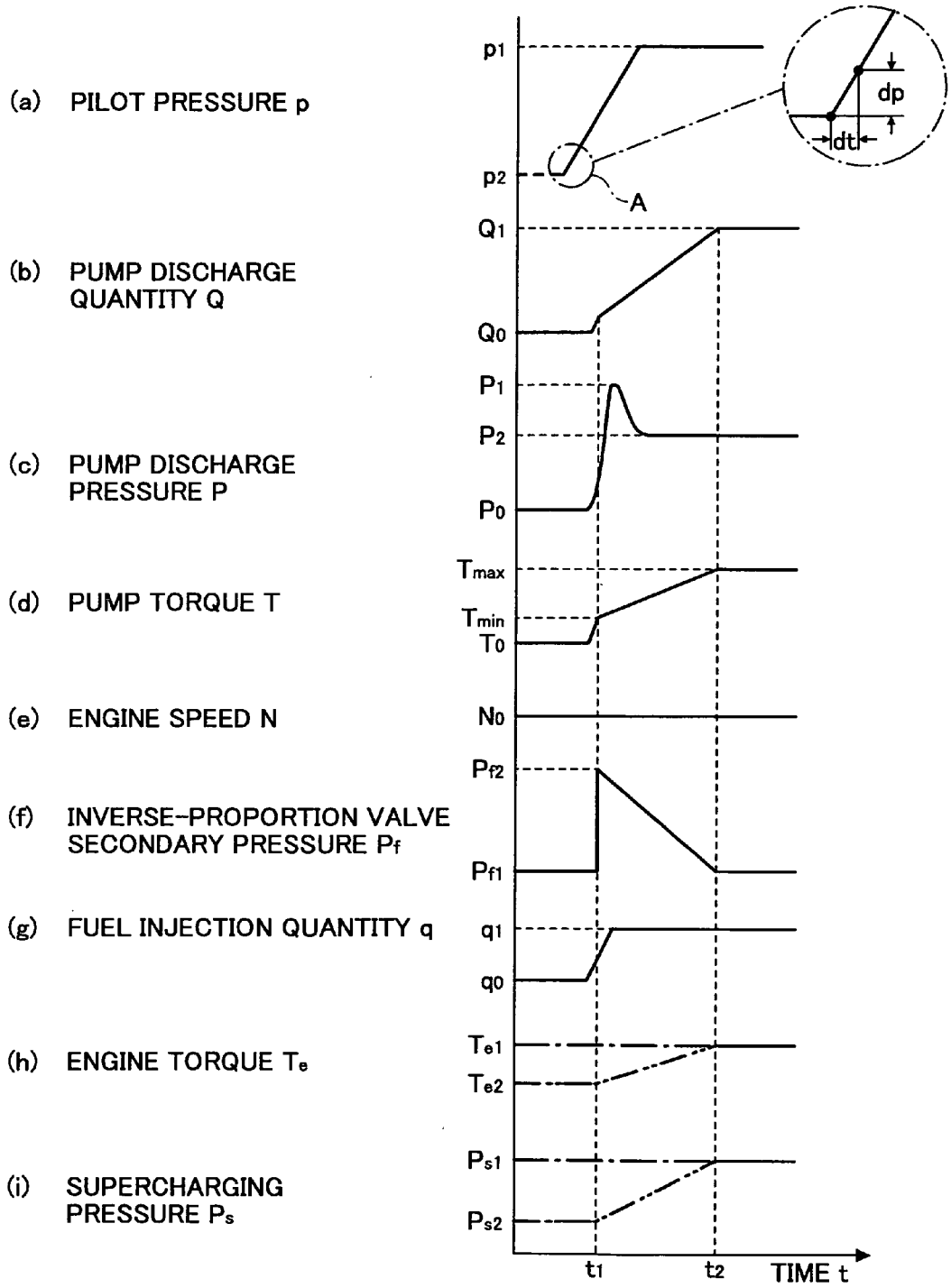
FIG. 3 is a time chart for explaining the respective characteristics of the embodiment of FIG. 1.

FIG. 1 shows the hydraulic circuit of an over-loading prevention device of construction machinery in an embodiment of the invention. FIG. 2 is a diagram for explaining a torque characteristic showing the relationship between a secondary pressure of an electromagnetic inverse-proportion valve and a pump input torque in the embodiment of FIG. 1. FIG. 3 is a time chart for explaining the respective characteristics of the embodiment of FIG. 1.

Figure 7:
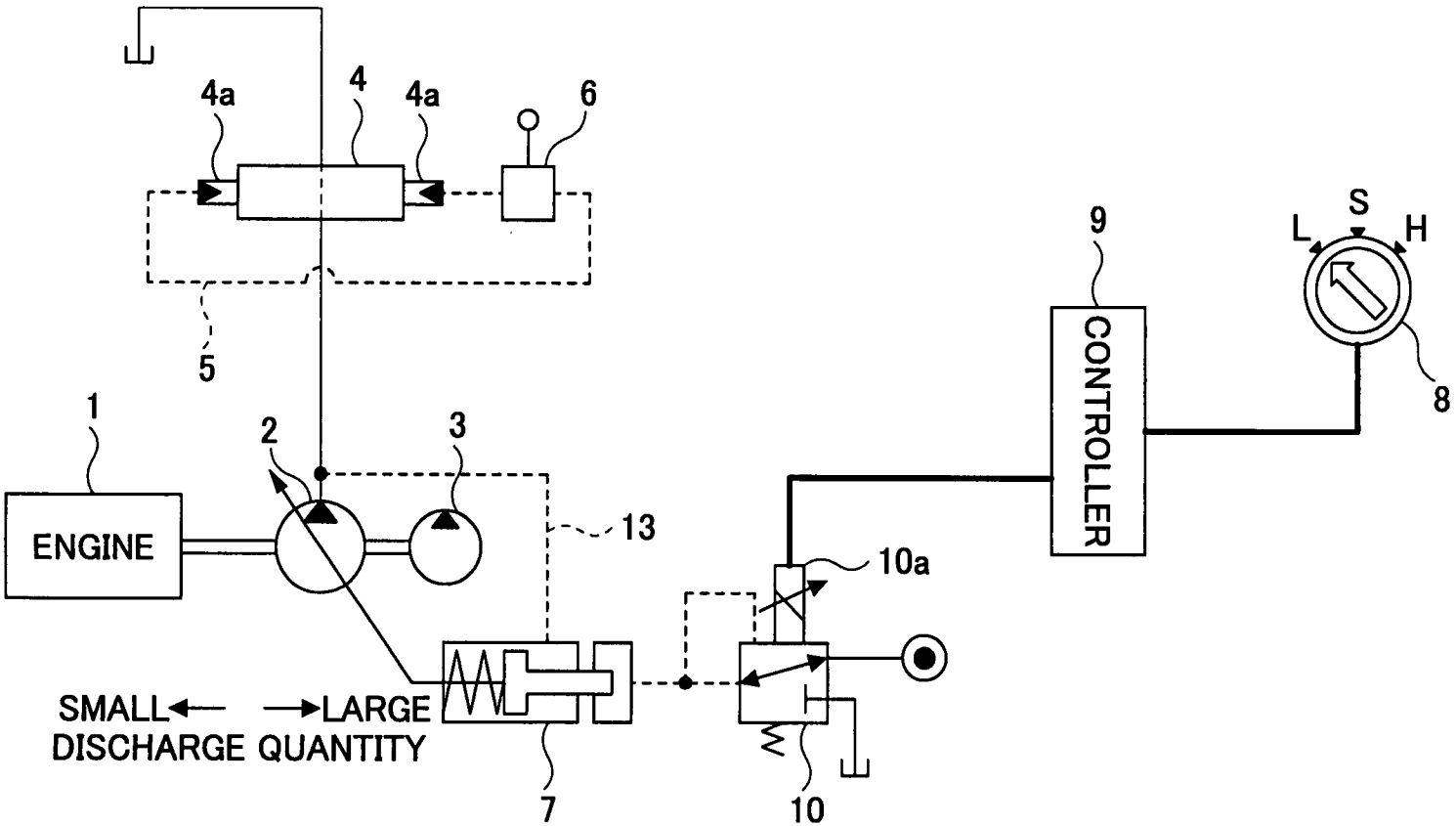
FIG. 7 is a diagram showing the hydraulic circuit of a conventional hydraulic-pump driving system controlling device of construction machinery.
Figure 8:
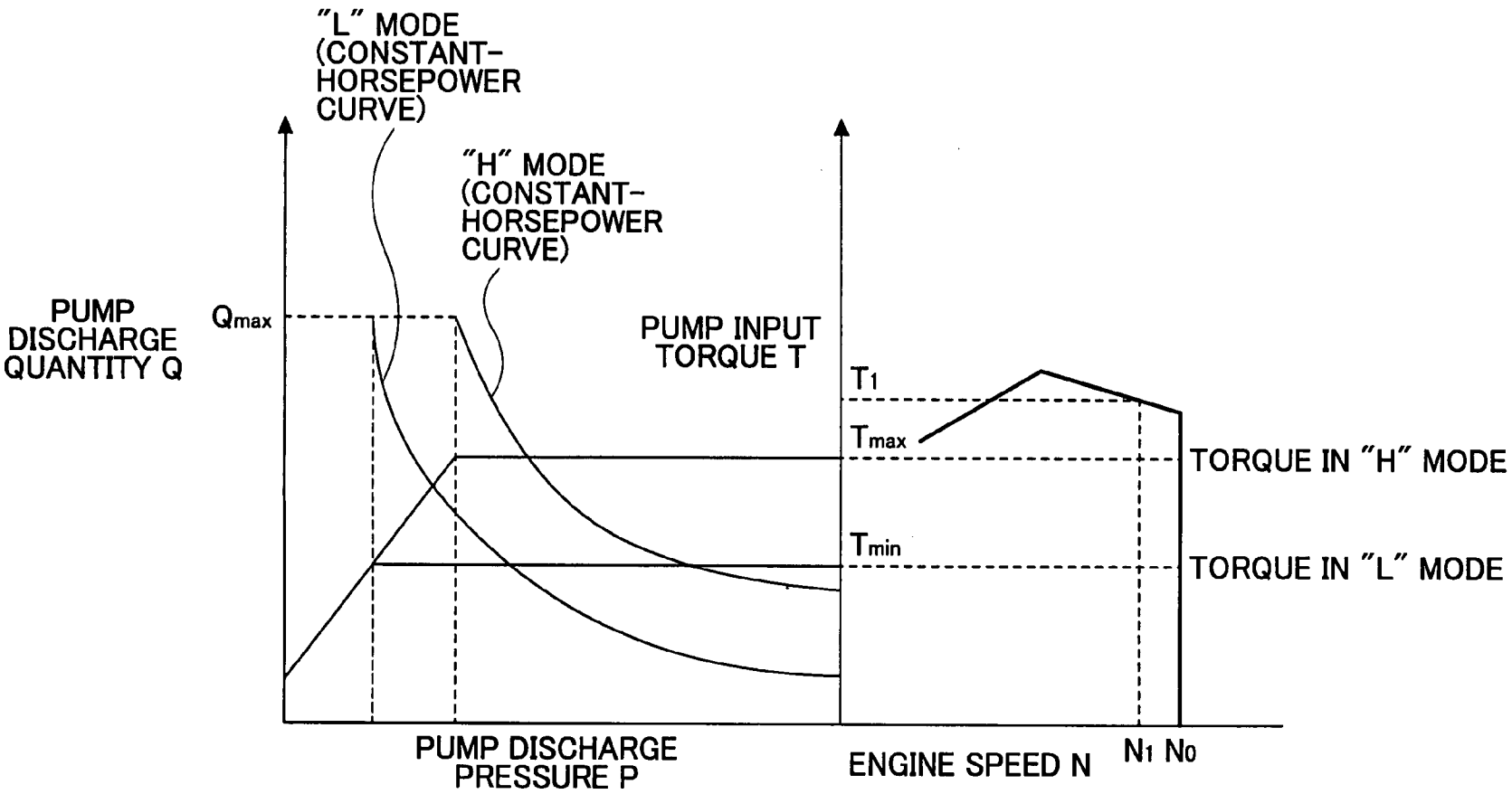
FIG. 8 is a diagram for explaining a constant-horsepower control in the hydraulic-pump driving system controlling device of FIG. 7 and the relationship between an engine speed and a pump input torque.
Figure 9:
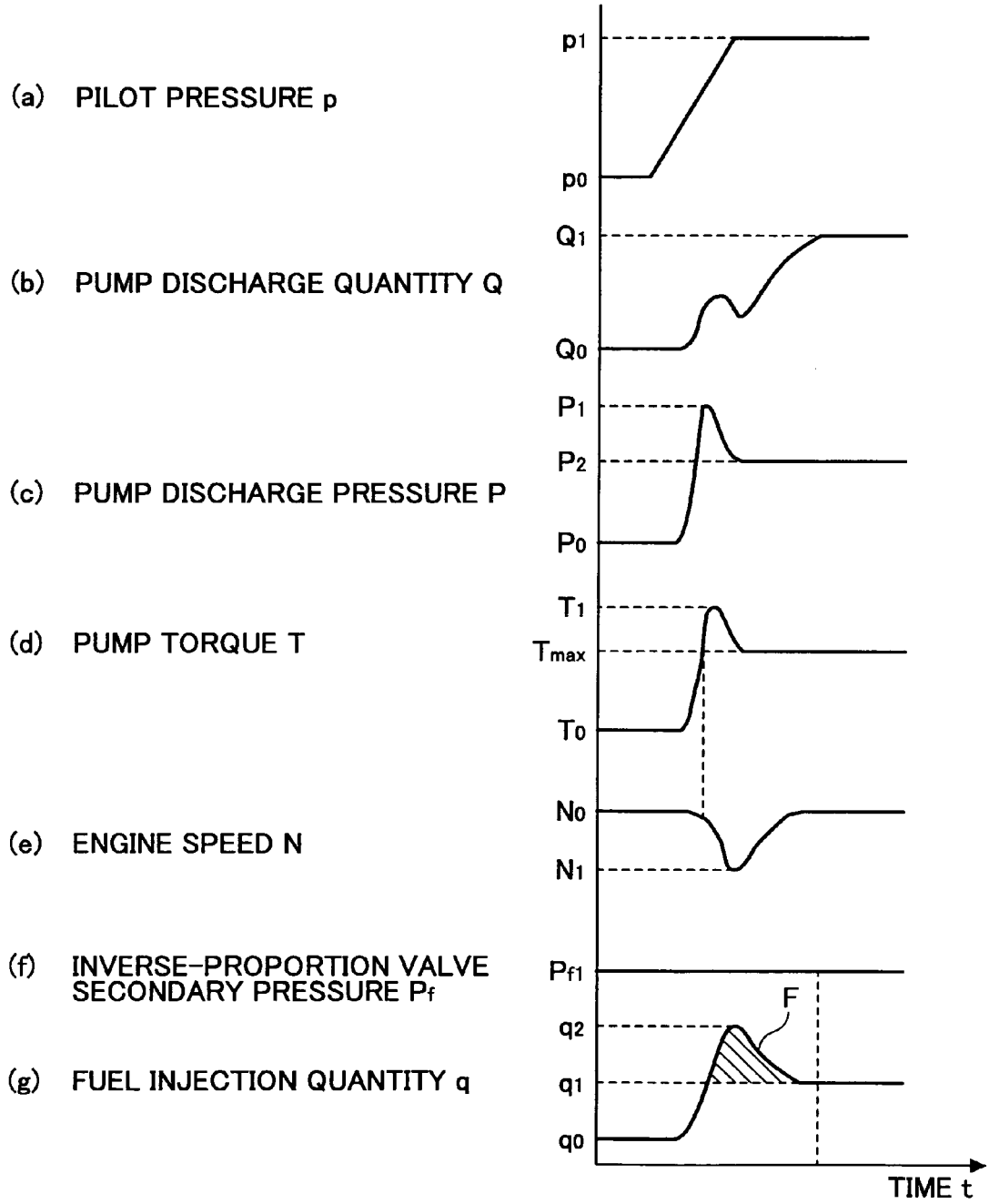
FIG. 9 is a time chart for explaining the respective characteristics of the hydraulic-pump driving system controlling device of FIG. 7.

In FIG. 1, the elements that are the same as corresponding elements in FIG. 7 are designated by the same reference numerals, and a description thereof will be omitted.

As mentioned above, in order to prevent occurrence of an engine lag-down at the time of a sudden rise of the discharge pressure of the hydraulic pump and prevent rapid increase of the engine fuel injection quantity, so as to reduce the fuel consumption for all the construction operations in construction machinery and improve the ease of operation of the hydraulic actuator, the over-loading prevention device of the construction machinery of this embodiment is arranged to include a hydraulic pump which is driven by an internal-combustion engine, a control valve which controls supply of hydraulic pressure from the hydraulic pump to a hydraulic actuator and exhaust of hydraulic pressure from the hydraulic actuator, a control lever which outputs a pilot pressure to operate the control valve, a discharge-quantity control unit which performs constant-torque control which decreases a discharge quantity in proportion to an increase in a discharge pressure in the hydraulic pump to control an input torque of the hydraulic pump uniformly, an operation-state detection unit which detects an actuation state of the control lever, and a control unit which outputs a control signal that sets the input torque of the hydraulic pump to a minimum torque value according to the constant-torque control, to the discharge-quantity control unit when it is determined based on the actuation state detected by the operation-state detection unit that the control lever is operated over a predetermined speed, and subsequently the control unit changing a level of the control signal to a maximum torque value according to the constant-torque control, in accordance with a predetermined control pattern to raise the input torque of the hydraulic pump.

In the over-loading prevention device of FIG. 1, a shuttle valve 11 is arranged in the pilot pressure introducing line 5 for introducing the pilot pressure from the control lever 6 into the pilot ports 4*a* and 4*a* of the control valve 4. The pilot pressure inputted to either of the pilot ports 4*a* and 4*a* is taken out by the shuttle valve 11, and this pilot pressure is supplied to a pressure sensor 12.

The discharge outlet of the variable capacity hydraulic pump 2 communicates with the hydraulic pressure inlet of the regulator (discharge-quantity control unit) 7 via the line 13. The variable capacity hydraulic pump 2 supplies a discharge pressure to the regulator 7 to decrease the discharge quantity in proportion to an increase in the discharge pressure. Thus, the variable capacity hydraulic pump 2 is operated by performing a constant-torque control (or constant-horsepower control) which controls uniformly the input torque of the variable capacity hydraulic pump 2, so that the input torque may not exceed an engine torque.

The pressure sensor 12 detects a pressure value of the pilot pressure and outputs a pilot pressure detection signal. The operation state detection unit which detects the actuation state of the control lever 6 is constituted by the pressure sensor 12 which is connected to the control lever 6 via the shuttle valve 11.

The pilot pressure detection signal of the pressure sensor 12 is outputted to the controller 9. The controller 9 computes an increase gradient dp/dt (see the enlarged diagram A in FIG. 3 (*a*)) of the pilot pressure based on the received pilot pressure detection signal, and determines whether the control lever 6 is operated over a predetermined speed based on the computed value of the increase gradient dp/dt.

When it is determined that the control lever 6 is operated over the predetermined speed, the controller 9 outputs a predetermined current signal, and this predetermined current signal is inputted to the actuator 10*a* of the electromagnetic inverse-proportion valve 10.

In response to the predetermined current signal, the electromagnetic inverse-proportion valve 10 outputs a control signal which decreases the input torque of the variable capacity hydraulic pump 2 to a predetermined value, and this control signal is inputted to the regulator 7 which is the discharge-quantity control unit.

Next, operation of the over-loading prevention device of FIG. 1 will be explained with reference to FIG. 2 and FIG. 3.

When sudden actuation of the control lever 6 is not performed and increase of the pilot pressure is mild, the discharge pressure P of the variable capacity hydraulic pump 2 rises gently. At this time, the constant-horsepower control in the variable capacity hydraulic pump 2 follows the mild increase of the discharge pressure P, and the input torque T of the variable capacity hydraulic pump 2 does not exceed an engine torque. Therefore, an engine lag-down does not occur and the fuel injection of the engine 1 is performed normally.

On the other hand, when sudden actuation of the control lever 6 is performed, the starting pressure for operating the hydraulic actuator occurs. As shown in FIG. 3 (*c*), the discharge pressure P of the variable capacity hydraulic pump 2 rises to P1 rapidly. At this time, a sudden rise of the pilot pressure accompanied with the sudden actuation of the control lever 6 is detected by the pressure sensor 12 through the shuttle valve 11, and the pilot pressure detection signal of the pressure sensor 12 is outputted to the controller 9.

The controller 9 detects that the increase gradient dp/dt of the pilot pressure is over a predetermined value "a" (dp/dt≥"a"), and determines that the control lever 6 is operated over the predetermined speed (refer to FIG. 3 (*a*)). The controller 9 outputs a predetermined current signal to the actuator 10*a* of the electromagnetic inverse-proportion valve 10 based on the result of this judgment.

The electromagnetic inverse-proportion valve 10 receives the predetermined current signal. And as shown in FIG. 2 and FIG. 3, the electromagnetic inverse-proportion valve 10 outputs the secondary pressure Pf2 which is a control signal that sets the input torque T of the variable capacity hydraulic pump 2 to the minimum torque value Tmin according to the constant-torque control (refer to FIGS. 3 (*d*) and (*f*)). The secondary pressure Pf2 of the electromagnetic inverse-proportion valve 10 is supplied to the regulator 7. As a result, even if the discharge pressure P is increased abruptly as mentioned above, increasing of the discharge quantity Q is suppressed, and the variable capacity hydraulic pump 2 is controlled so that the input torque T does not exceed an engine torque (refer to FIGS. 3 (*b*), (*c*) and (*d*)).

Up to the instant t2, after a predetermined time has passed from the instant t1 the secondary pressure Pf2 is outputted by the electromagnetic inverse-proportion valve 10, the controller 9 changes the signal level of the secondary pressure Pf outputted by the electromagnetic inverse-proportion valve 10, from the secondary pressure Pf2 which is equivalent to the minimum torque value Tmin according to the constant-torque control of the variable capacity hydraulic pump 2, to the secondary pressure Pf1 which is equivalent to the maximum torque value Tmax according to the constant-torque control, in accordance with a predetermined control pattern.

By changing the secondary pressure Pf outputted by the electromagnetic inverse-proportion valve 10, the input torque T of the variable capacity hydraulic pump 2 is increased to the maximum torque value Tmax according to the constant-torque control.

The predetermined control pattern which is used by the controller 9 in order to change the signal level of the secondary pressure Pf of the electromagnetic inverse-proportion valve 10 is selected from among the following ones:

(1) a first control pattern that causes the signal level of the secondary pressure Pf of the electromagnetic inverse-proportion valve 10 to be returned within a predetermined time to the level equivalent to the maximum torque value Tmax according to the constant-torque control of the variable capacity hydraulic pump 2;

(2) a second control pattern that causes the signal level of the secondary pressure Pf of the electromagnetic inverse-proportion valve 10 to be returned by a number of increments of an arbitrary amount to the level equivalent to the maximum torque value Tmax according to the constant-torque control of the variable capacity hydraulic pump 2 when the engine speed of the engine 1 is within a range of a predetermined engine speed to a target engine speed; and (3) a third control pattern that causes the signal level of the secondary pressure Pf of the electromagnetic inverse-proportion valve 10 to be temporarily returned to an arbitrary level within a predetermined time, and subsequently causes the signal level of the secondary pressure Pf of the electromagnetic inverse-proportion valve 10 to be gradually returned by a number of increments of an arbitrary amount to the level equivalent to the maximum torque value Tmax according to the constant-torque control of the variable capacity hydraulic pump 2 when the engine speed of the engine 1 is within a predetermined engine speed to a target engine speed.

As described above, in the over-loading prevention device of this embodiment, the control is carried out so that the input torque T of the variable capacity hydraulic pump 2 does not exceed the engine torque, even if sudden actuation of the control lever 6 is performed and the discharge pressure P of the variable capacity hydraulic pump 2 is increased abruptly. Occurrence of an engine lag-down in which the engine speed of the engine 1 falls temporarily can be prevented, and rapid increase of the fuel injection quantity of the engine 1 can be prevented (refer to FIGS. 3 (*e*) and (*g*)). Therefore, the fuel consumption for all the construction operations in construction machinery can be reduced.

Since the engine lag-down does not occur, the phenomenon in which the discharge quantity Q of the variable capacity hydraulic pump 2 falls temporarily does not occur, and the ease of operation of the hydraulic actuator which operates by the hydraulic pressure supplied from the variable capacity hydraulic pump 2 can be improved.

In the controlled condition in which the input torque T of the variable capacity hydraulic pump 2 does not exceed the engine torque, the control pattern processing is performed in which the signal level of the secondary pressure Pf of the electromagnetic inverse-proportion valve 10 is also returned within a predetermined time to the level equivalent to the maximum torque value Tmax according to the constant-torque control of the variable capacity hydraulic pump 2. Thus, the input torque T of the variable capacity hydraulic pump 2 can be returned to the controlled condition before sudden actuation of the control lever 6.

Next, a description will be given of another embodiment of the invention.

The case in which an internal combustion engine having a supercharger is used for a drive system of construction machinery, such as a hydraulic excavator, is taken into consideration. In this case, regardless of whether the supercharging pressure is adequate or inadequate, it is desirable that, when the pilot pressure is increased rapidly according to the digging state or the actuation state, occurrence of an engine lag-down be prevented and the fuel consumption be reduced without worsening the ease of operation of the hydraulic actuator, similar to the previously described embodiment.

In the case of the internal combustion engine having a supercharger used for the drive system of construction machinery, when the construction machinery is in a heavy-load state during operation of the construction machinery, or at the time of restart of the operation promptly after the operation stop, etc., an adequately high supercharging pressure Ps1 is obtained as the engine supercharging pressure Ps as indicated by the one-dot chain line in FIG. 3 (*i*).

On the other hand, when the construction machinery is in the non-operation condition (unloaded condition), the engine supercharging pressure Ps is set to a comparatively low supercharging pressure Ps2 as indicated by the two-dot chain line in FIG. 3 (*i*). In this condition, an adequately large output torque of the engine is not obtained. When the supercharging pressure Ps is set to Ps1, a sufficiently large torque Te1 is obtained as the supercharged engine torque Te as indicated by the two-dot chain line in FIG. 3 (*h*). When the supercharging pressure Ps is set to Ps2, a comparatively small torque Te2 is obtained as the supercharged engine torque Te as indicated by the one-dot chain line in FIG. 3 (*h*).

However, in the conventional hydraulic-pump driving system controlling device, regardless of whether the engine is in the heavy-load condition or in the unloaded condition, the same control is carried out. That is, when the supercharged engine torque Te is set to Te1, the input torque of the hydraulic pump is held down at the low level that is the same as when the supercharged engine torque Te is set to Te2, although a larger amount of work may be obtained by setting the input torque of the hydraulic pump to a larger value. This may cause the ease of operation to worsen, e.g., the acceleration of the hydraulic actuator being not responsive to operation.

In order to solve the above-mentioned problem, the over-loading prevention device of construction machinery in the following embodiment is arranged to include: a hydraulic pump which is driven by an internal-combustion engine having a supercharger; a control valve which controls supply of hydraulic pressure from the hydraulic pump to a hydraulic actuator and exhaust of hydraulic pressure from the hydraulic actuator; a control lever which outputs a pilot pressure to operate the control valve; a discharge-quantity control unit which performs constant-torque control which decreases a discharge quantity in proportion to an increase in a discharge pressure in the hydraulic pump to control an input torque of the hydraulic pump uniformly; an operation-state detection unit which detects an actuation state of the control lever; a supercharging pressure detection unit which detects a supercharging pressure of the engine; and a control unit which outputs a control signal that sets the input torque of the hydraulic pump to a predetermined value, to the discharge-quantity control unit when it is determined based on the actuation state detected by the operation-state detection unit that the control lever is operated over a predetermined speed, the control unit changing the predetermined value set by the control signal to an arbitrary value between a minimum torque value and a maximum torque value according to the constant-torque control according to a supercharged engine torque calculated beforehand based on the supercharging pressure of the engine detected by the supercharging pressure detection unit.

Figure 4:
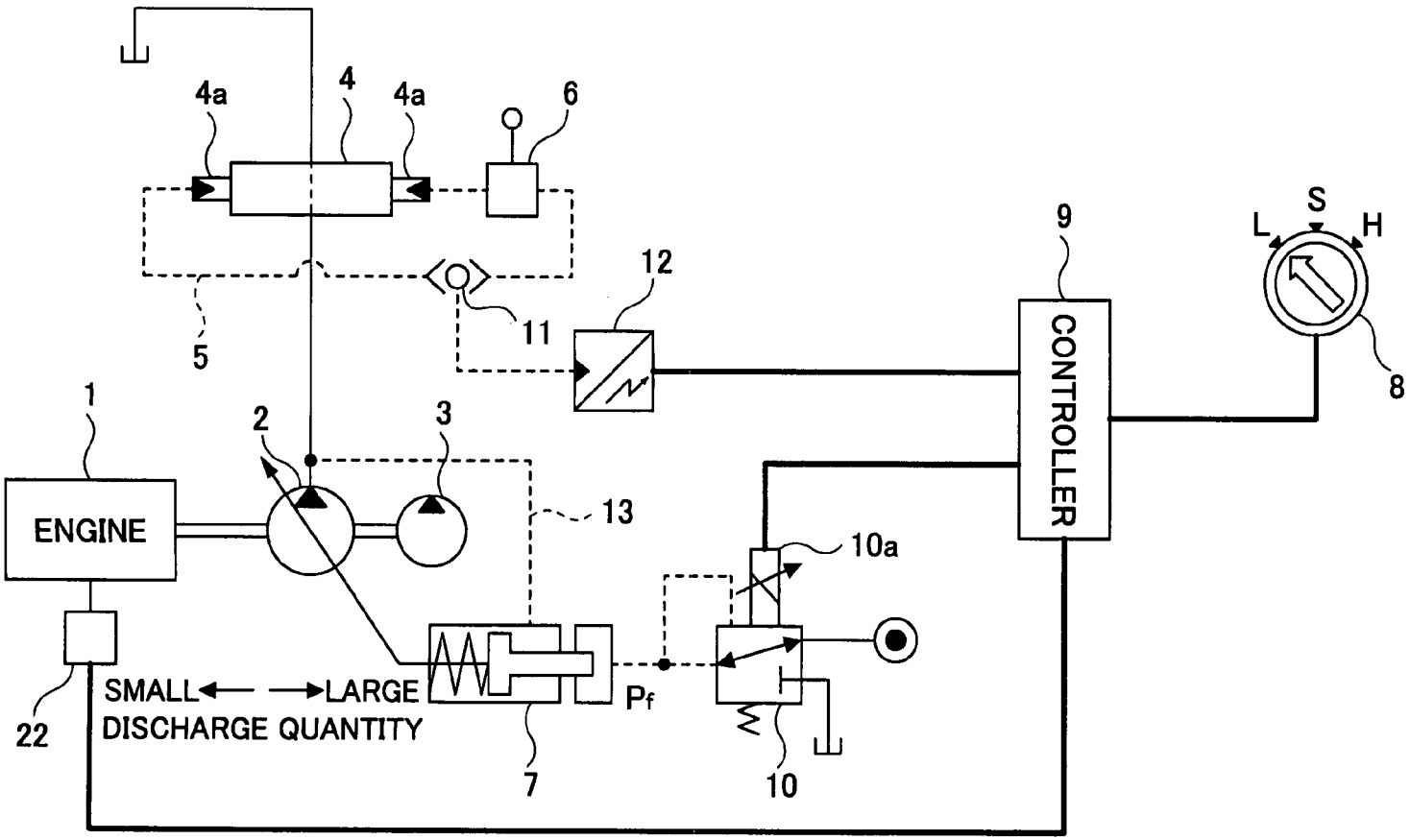
FIG. 4 is a diagram showing the hydraulic circuit of an over-loading prevention device of construction machinery in an embodiment of the invention.
Figure 5:
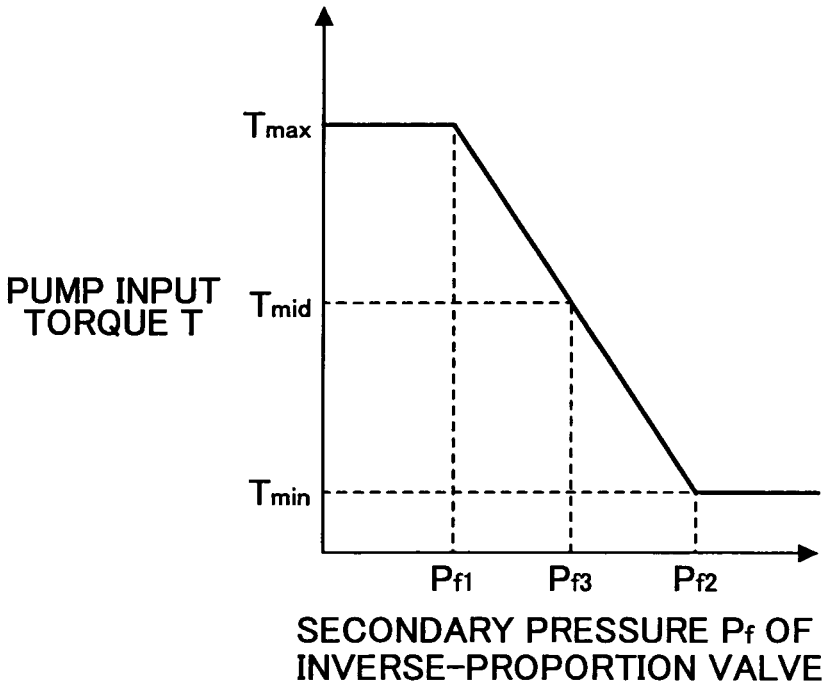
FIG. 5 is a diagram for explaining the torque characteristic showing the relationship between a secondary pressure of an electromagnetic inverse-proportion valve and a pump input torque in the embodiment of FIG. 4.
Figure 6:
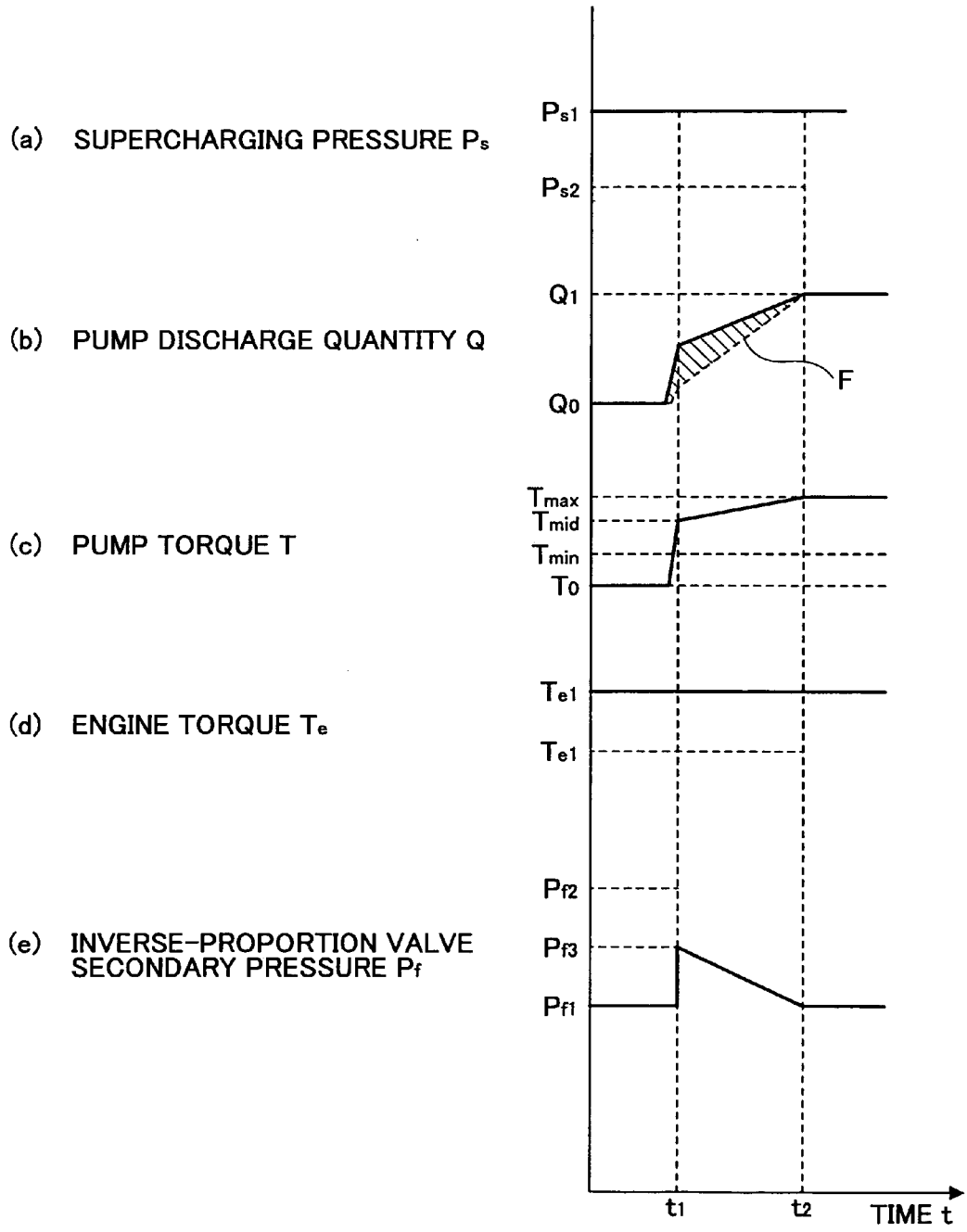
FIG. 6 is a time chart for explaining the respective characteristics of the embodiment of FIG. 4.

FIG. 4 is a diagram showing the hydraulic circuit of an over-loading prevention device of construction machinery in an embodiment of the invention. FIG. 5 is a diagram for explaining the torque characteristics showing the relationship between a secondary pressure of an electromagnetic inverse-proportion valve and a pump input torque in the embodiment of FIG. 4. FIG. 6 is a time chart for explaining the respective characteristics of the embodiment of FIG. 4.

In FIG. 4, the elements which are the same as corresponding elements in FIG. 1 are designated by the same reference numerals, and a description thereof will be omitted.

In the over-loading prevention device of FIG. 4, a supercharging pressure sensor 22 is attached to an engine 1 having a supercharger, and this supercharging pressure sensor 22 detects a supercharging pressure which is supplied to the engine 1 during operation, and outputs a supercharging pressure detection signal to the controller 9. A shuttle valve 11 is arranged in the pilot pressure introducing line 5 for introducing the pilot pressure from the control lever 6 into the pilot ports 4*a* and 4*a* of the control valve 4. The pilot pressure inputted to either of the pilot ports 4*a* and 4*a* is taken out by the shuttle valve 11, and this pilot pressure is supplied to a pressure sensor 12.

The discharge outlet of the variable capacity hydraulic pump 2 communicates with the hydraulic pressure inlet of the regulator (discharge-quantity control unit) 7 via the line 13. The variable capacity hydraulic pump 2 supplies a discharge pressure to the regulator 7 to decrease the discharge quantity in proportion to an increase in the discharge pressure. Thus, the variable capacity hydraulic pump 2 is operated by performing a constant-torque control (or constant-horsepower control) which controls uniformly the input torque of the variable capacity hydraulic pump 2, so that the input torque may not exceed an engine torque.

The pressure sensor 12 detects a pressure value of the pilot pressure and outputs a pilot pressure detection signal. The operation state detection unit which detects the actuation state of control lever 6 is constituted by the pressure sensor 12 which is connected to the control lever 6 via the shuttle valve 11.

The pilot pressure detection signal of the pressure sensor 12 is outputted to the controller 9. The controller 9 computes an increase gradient dp/dt (see the enlarged diagram A in FIG. 3 (*a*)) of the pilot pressure based on the received pilot pressure detection signal, and determines whether the control lever 6 is operated over a predetermined speed based on the computed value of the increase gradient dp/dt.

When it is determined that the control lever 6 is operated over the predetermined speed, the controller 9 outputs a predetermined current signal, and this predetermined current signal is inputted into the actuator 10*a* of the electromagnetic inverse-proportion valve 10.

In response to the predetermined current signal, the electromagnetic inverse-proportion valve 10 outputs a control signal which decreases the input torque of the variable capacity hydraulic pump 2 to a predetermined value, and this control signal is inputted to the regulator 7 which is the discharge-quantity control unit.

The controller 9 in the over-loading prevention device of FIG. 4 computes beforehand a supercharged engine torque Te of the engine 1 according to the supercharging pressure detection value based on the supercharging pressure detection signals received from the supercharging pressure sensor 22 in various operating states of the engine 1.

For example, as shown in FIGS. 6 (*a*) and (*d*), when the supercharging pressure Ps in a heavy-load state is set to Ps1, the supercharged engine torque Te of the engine 1 is computed as being a sufficiently large torque value Te1. Similarly, when the supercharging pressure Ps in an unloaded condition is set to Ps2, the supercharged engine torque Te is computed as being a comparatively small torque value Te2 (Ps1>Ps2, Te1>Te2).

Next, operation of the over-loading prevention device of FIG. 4 will be explained with reference to FIG. 5 and FIG. 6.

When sudden actuation of the control lever 6 is not performed and increase of the pilot pressure is mild, the discharge pressure P of the variable capacity hydraulic pump 2 rises gently. At this time, the constant-horsepower control in the variable capacity hydraulic pump 2 follows the mild increase of the discharge pressure P, and the input torque T of the variable capacity hydraulic pump 2 does not exceed an engine torque. Therefore, an engine lag-down does not occur and the fuel injection of the engine 1 is performed normally.

On the other hand, when sudden actuation of the control lever 6 is performed, the controller 9 detects that the increase gradient dp/dt of the pilot pressure which is indicated by the pilot pressure detection signal of the pressure sensor 12 is over a predetermined value "a" (dp/dt≥"a"), and determines that the control lever 6 is operated over the predetermined speed. The controller 9 outputs a predetermined current signal to the actuator 10*a* of the electromagnetic inverse-proportion valve 10 based on the result of this judgment.

The electromagnetic inverse-proportion valve 10 receives the predetermined current signal. And as shown in FIG. 5 and FIG. 6, the electromagnetic inverse-proportion valve 10 outputs the secondary pressure Pf3 which is a control signal which sets the input torque T of the variable capacity hydraulic pump 2 to an arbitrary intermediate torque value Tmid between the maximum torque value Tmax and the minimum torque value Tmin according to the constant-torque control (refer to FIGS. 6 (*c*) and (*e*)).

The secondary pressure Pf3 of the electromagnetic inverse-proportion valve 10 is supplied to the regulator 7. As a result, the variable capacity hydraulic pump 2 is controlled so that, even if the discharge pressure P is increased abruptly, increase of the discharge quantity Q is suppressed and the input torque T does not exceed an engine torque, similar to the embodiment of FIG. 1. Moreover, when the supercharged engine torque Te of the engine 1 is set to a sufficiently large torque value Te1, the discharge quantity Q of the hydraulic pump which is larger than in the case of the embodiment of FIG. 1 is obtained as indicated by the shaded portion F in FIG. 6 (*b*). It is possible to make the acceleration of the hydraulic actuator responsive to operation.

Up to the instant t2, after a predetermined time has passed from the instant t1 the secondary pressure Pf3 is outputted by the electromagnetic inverse-proportion valve 10, the controller 9 changes the signal level of the secondary pressure Pf outputted by the electromagnetic inverse-proportion valve 10, from the secondary pressure Pf3 equivalent to the intermediate torque value Tmid between the maximum torque value Tmax and the minimum torque value Tmin according to the constant-torque control of the variable capacity hydraulic pump 2, to the secondary pressure Pf1 equivalent to the maximum torque value Tmax according to the constant-torque control, in accordance with a predetermined control pattern.

By changing the secondary pressure Pf outputted by the electromagnetic inverse-proportion valve 10, the input torque T of the variable capacity hydraulic pump 2 is increased to the maximum torque value Tmax according to the constant-torque control.

Similar to the embodiment of FIG. 1, the predetermined control pattern which is used by the controller 9 in the embodiment of FIG. 4 in order to change the signal level of the secondary pressure Pf of the electromagnetic inverse-proportion valve 10 is selected from among the following ones:

(1) a first control pattern that causes the signal level of the secondary pressure Pf of the electromagnetic inverse-proportion valve 10 to be returned within a predetermined time to the level equivalent to the maximum torque value Tmax according to the constant-torque control of the variable capacity hydraulic pump 2;

(2) a second control pattern that causes the signal level of the secondary pressure Pf of the electromagnetic inverse-proportion valve 10 to be returned by a number of increments of an arbitrary amount to the level equivalent to the maximum torque value Tmax according to the constant-torque control of the variable capacity hydraulic pump 2 when the engine speed of the engine 1 is within a range of a predetermined engine speed to a target engine speed; and (3) a third control pattern that causes the signal level of the secondary pressure Pf of the electromagnetic inverse-proportion valve 10 to be temporarily returned to an arbitrary level within a predetermined time, and subsequently causes the signal level of the secondary pressure Pf of the electromagnetic inverse-proportion valve 10 to be gradually returned by a number of increments of an arbitrary amount to the level equivalent to the maximum torque value Tmax according to the constant-torque control of the variable capacity hydraulic pump 2 when the engine speed of the engine 1 is within a predetermined engine speed to a target engine speed.

As described above, the over-loading prevention device of the embodiment of FIG. 4 is controlled so that the input torque T of the variable capacity hydraulic pump 2 does not exceed an engine torque, even if sudden actuation of the control lever 6 is performed and the discharge pressure P of the variable capacity hydraulic pump 2 is increased abruptly. Occurrence of an engine lag-down in which the engine speed of the engine 1 falls temporarily can be prevented and rapid increase of the fuel injection quantity of the engine 1 can be prevented. Therefore, the fuel consumption for all the construction operations in construction machinery can be reduced. Moreover, when the supercharged engine torque is set to a sufficiently large torque value, the discharge quantity of a hydraulic pump which is larger than in the case of the embodiment of FIG. 1 can be obtained. Thus, it is possible to make the acceleration of the hydraulic actuator responsive to operation.

In the example of FIG. 6, only the case in which the supercharging pressure is set to Ps1 is illustrated. However, the supercharging pressure value varies depending on the engine operations and the supercharged engine torque varies according to the supercharging pressure value. Accordingly, changes of the supercharging pressure Ps, the electromagnetic inverse-proportion valve secondary pressure Pf and the pump torque T are not limited to the example of FIG. 6. The controller 9 in this embodiment changes the secondary pressure Pf of the electromagnetic inverse-proportion valve 10 based on the detected supercharging pressure, and it is possible for the controller 9 in this embodiment to adjust the input torque of the hydraulic pump 2 to the optimal value for the engine torque at that time.

As described in the foregoing, according to the embodiment of FIG. 4, occurrence of an engine lag-down is prevented and unnecessary fuel injection is avoided, and it is possible to improve the fuel consumption of the engine. In addition, the discharge quantity of the hydraulic pump can be enlarged when the supercharged engine torque is sufficiently large, and it is possible to ensure that the acceleration of the hydraulic actuator is responsive to operation.

In the above-mentioned embodiment, the electromagnetic inverse-proportion valve is controlled by detection of sudden actuation of the control lever. Alternatively, the electromagnetic inverse-proportion valve may be controlled by detection of a sudden rise of the discharge pressure of the hydraulic pump. Moreover, in the above-mentioned embodiment, the electromagnetic inverse-proportion valve is provided as a specifically disclosed example. Alternatively, the same effects of the invention may be obtained even when any of electromagnetic proportional valves or other solenoid controlled valves is used.

The present invention is not limited to the above-described embodiments, and variations and modifications may be made without departing from the scope of the present invention.

The present application is based on and claims the benefit of priority of Japanese patent application No. 2006-131975, filed on May 10, 2006, the entire contents of which are hereby incorporated by reference.

The invention claimed is:

1. An over-loading prevention device of construction machinery, comprising:

a hydraulic pump which is driven by an internal-combustion engine;

a control valve which controls supply of hydraulic pressure from the hydraulic pump to a hydraulic actuator and exhaust of hydraulic pressure from the hydraulic actuator;

a control lever which outputs a pilot pressure to operate the control valve;

a discharge-quantity control unit which performs constant-torque control which decreases a discharge quantity in proportion to an increase in a discharge pressure in the hydraulic pump to control an input torque of the hydraulic pump uniformly;

an operation-state detection unit which detects the pilot pressure output from the control lever to determine an actuation speed of the control lever; and a control unit which outputs a control signal that sets the input torque of the hydraulic pump to a minimum torque value according to the constant-torque control, to the discharge-quantity control unit when it is determined based on the actuation speed determined by the operation-state detection unit that the control lever is operated over a predetermined speed, and subsequently the control unit changing a level of the control signal to a maximum torque value according to the constant-torque control, in accordance with a predetermined control pattern to raise the input torque of the hydraulic pump.

2. An over-loading prevention device of construction machinery, comprising:

a hydraulic pump which is driven by an internal-combustion engine;

a control valve which controls supply of hydraulic pressure from the hydraulic pump to a hydraulic actuator and exhaust of hydraulic pressure from the hydraulic actuator;

a control lever which outputs a pilot pressure to operate the control valve;

a discharge-quantity control unit which performs constant-torque control which decreases a discharge quantity in proportion to an increase in a discharge pressure in the hydraulic pump to control an input torque of the hydraulic pump uniformly;

an operation-state detection unit which detects an actuation speed of the control lever; and a control unit which outputs a control signal that sets the input torque of the hydraulic pump to a minimum torque value according to the constant-torque control, to the discharge-quantity control unit when it is determined based on the actuation speed detected by the operation-state detection unit that the control lever is operated over a predetermined speed, and subsequently the control unit changing a level of the control signal to a maximum torque value according to the constant-torque control, in accordance with a predetermined control pattern to raise the input torque of the hydraulic pump, wherein the predetermined control pattern used by the control unit is selected from among a first control pattern that causes the level of the control signal to be returned to a level equivalent to the maximum torque value within a predetermined time, a second control pattern that causes the level of the control signal to be gradually returned by a number of increments of an arbitrary amount to a level equivalent to the maximum torque value when an engine speed of the engine is within a range of a given engine speed to a target engine speed, and a third control pattern that causes the level of the control signal to be temporarily returned to an arbitrary level within a predetermined time and subsequently causes the level of the control signal to be gradually returned by a number of increments of an arbitrary amount to a level equivalent to the maximum torque value when an engine speed of the engine is within a range of a given engine speed to a target engine speed.

3. An over-loading prevention device of construction machinery, comprising:

a hydraulic pump which is driven by an internal-combustion engine;

a control valve which controls supply of hydraulic pressure from the hydraulic pump to a hydraulic actuator and exhaust of hydraulic pressure from the hydraulic actuator;

a control lever which outputs a pilot pressure to operate the control valve;

a discharge-quantity control unit which performs constant-torque control which decreases a discharge quantity in proportion to an increase in a discharge pressure in the hydraulic pump to control an input torque of the hydraulic pump uniformly;

an operation-state detection unit which detects an actuation speed of the control lever; and a control unit which outputs a control signal that sets the input torque of the hydraulic pump to a minimum torque value according to the constant-torque control, to the discharge-quantity control unit when it is determined based on the actuation speed detected by the operation-state detection unit that the control lever is operated over a predetermined speed, and subsequently the control unit changing a level of the control signal to a maximum torque value according to the constant-torque control, in accordance with a predetermined control pattern to raise the input torque of the hydraulic pump, wherein the hydraulic pump is constituted by a variable capacity hydraulic pump, and the operation-state detection unit is constituted by a pressure sensor connected to the control lever.

4. An over-loading prevention device of construction machinery, comprising:

a hydraulic pump which is driven by an internal-combustion engine having a supercharger;

a control valve which controls supply of hydraulic pressure from the hydraulic pump to a hydraulic actuator and exhaust of hydraulic pressure from the hydraulic actuator;

a control lever which outputs a pilot pressure to operate the control valve;

a discharge-quantity control unit which performs constant-torque control which decreases a discharge quantity in proportion to an increase in a discharge pressure in the hydraulic pump to control an input torque of the hydraulic pump uniformly;

an operation-state detection unit which detects an actuation state of the control lever;

a supercharging pressure detection unit which detects a supercharging pressure of the engine; and a control unit which outputs a control signal that sets the input torque of the hydraulic pump to a predetermined value, to the discharge-quantity control unit when it is determined based on the actuation state detected by the operation-state detection unit that the control lever is operated over a predetermined speed, the control unit changing the predetermined value set by the control signal to an arbitrary value between a minimum torque value and a maximum torque value according to the constant-torque control according to a supercharged engine torque calculated beforehand based on the supercharging pressure of the engine detected by the supercharging pressure detection unit.

5. The over-loading prevention device according to claim 4, wherein the hydraulic pump is constituted by a variable capacity hydraulic pump, the operation-state detection unit is constituted by a pressure sensor connected to the control lever, and the supercharging pressure detection unit is constituted by a pressure sensor attached to the engine.

* * * * *